US005201120A

United States Patent [19]

Patrick

[11] Patent Number: 5,201,120

[45] Date of Patent: Apr. 13, 1993

[54] METHOD FOR CONSTRUCTING SHELVING

[76] Inventor: Michael E. Patrick, 9630 N. 100th St., Scottsdale, Ariz. 85258

[21] Appl. No.: 899,999

[22] Filed: Jun. 17, 1992

[51] Int. Cl.[5] ..... B23P 11/02; A47G 29/02

[52] U.S. Cl. ..... 29/897.31; 29/525.1; 211/186; 248/248; 248/250; 248/300

[58] Field of Search ..... 29/897.3, 897.31, 525.1; 108/108; 211/186, 188; 248/247, 248, 250, 235, 245, 249, 236, 300, 243; 312/111

[56] References Cited

U.S. PATENT DOCUMENTS

| | | | |
|---|---|---|---|
| 1,894,310 | 1/1932 | Geuth et al. . | |
| 2,157,309 | 5/1939 | Swedman et al. | 248/243 |
| 2,263,282 | 11/1941 | Welch et al. | 248/243 |
| 3,471,112 | 10/1969 | MacDonald et al. | 248/243 X |
| 4,183,488 | 1/1980 | Shepard . | |
| 4,191,110 | 3/1980 | Klukos . | |
| 4,231,300 | 11/1980 | Shepard . | |
| 4,653,712 | 3/1987 | Murray et al. . | |
| 4,732,358 | 3/1988 | Hughes et al. | 248/243 |
| 4,799,643 | 1/1989 | Shepard | 248/247 X |
| 4,819,901 | 4/1989 | McDonald | 248/243 X |
| 4,856,746 | 8/1989 | Wrobel et al. | 248/250 |
| 4,909,465 | 3/1990 | Lymann | 248/250 |
| 5,026,015 | 6/1991 | Patrick | 248/250 |

*Primary Examiner*—Timothy V. Eley
*Attorney, Agent, or Firm*—Cahill, Sutton & Thomas

[57] ABSTRACT

A method for constructing shelving includes the step of providing first and second shelf brackets. Each of the shelf brackets comprises a rectangular vertically extending main surface having a plurality of equally spaced first legs extending vertically from a first end of the main surface, the first legs have a rectangular shape and a length approximately equal to a standard board thickness, and a first horizontally extending arm is located between adjacent first legs.

A plurality of equally spaced second arms extend horizontally from a second end of the main surface in the same direction as the first arms; the second arms are adapted to support one of two opposing end edges of a standard board thereon. A second vertically extending leg is located between adjacent second arms, the second leg extending in a direction opposite from that of the first legs; the second leg has a shape and length similar to that of the first leg. The first and second shelf brackets are placed against opposing walls, and opposing end edges of the standard board are placed on opposing second arms of the shelf brackets.

8 Claims, 2 Drawing Sheets

METHOD FOR CONSTRUCTING SHELVING

BACKGROUND OF THE INVENTION

The invention relates generally to a method for constructing shelving. More particularly, this invention relates to a method for constructing shelving between opposing walls by using frame brackets for supporting precut boards which form shelves.

Shelves are common storage furnishings intended to hold a variety of items such as books, decorative objects and clothes. One frequently used shelf is that located above hanging clothes in a closet. Folded clothes, accessories and the like are commonly stacked on the single closet shelf. However, the stacked items will fall over if stacked much higher than approximately twelve inches. Therefore, the area between the top of the stack to the closet ceiling is unusable storage space.

Shelving can of course be provided by furniture such as bookcases. However, many people needing shelf space do not want to buy expensive furniture simply to store clothes, books and the like; instead, people prefer to modify existing storage spaces by adding shelves supported by brackets such as those disclosed in U.S. Pat. Nos. 4,183,488 and 4,231,300 to Shepard. In the Shepard patents, brackets located on opposite sides of shelves are provided with U-clips that extend underneath and on top of the shelves. The geometry of the brackets precludes placement of one bracket directly above another bracket when constructing multi-shelved units. Therefore, shelving constructed with the Shepard brackets would be difficult to accommodate in limited areas such as closets.

SUMMARY OF INVENTION

Briefly described, and in accordance with one embodiment of the invention, the invention provides a method for constructing shelving. The preferred method includes the step of providing first and second shelf brackets. Each of the shelf brackets comprises a rectangular vertically extending main surface having a plurality of equally spaced first legs extending vertically from a first end of the main surface; the first legs have a rectangular shape and a length approximately equal to a standard board thickness, and a first horizontally extending arm is located between adjacent first legs. A plurality of equally spaces second arms extend horizontally from a second end of the main surface in the same direction as the first arms; the second arms are adapted to support one of two opposing end edges of a standard board thereon. A second vertically extending leg is located between adjacent second arms, the second leg extending in a direction opposite from that of the first legs; the second leg has a shape and length similar to that of the first leg. The first and second half brackets are placed against opposing walls, and opposing end edges of the standard board are placed on opposing second arms of the shelf brackets.

It is an object of the present invention to provide a method for constructing shelving from inexpensive, lightweight shelf frame brackets adapted to support precut boards which can quickly and easily be assembled into a stable multishelved unit.

It is another object of the present invention to provide a method for constructing shelving from shelf frame brackets which brackets are capable of stably supporting a plurality of precut boards and which method enables shelving to be quickly and easily installed in and removed from an existing storage area without tools and without the need for drilling holes in or otherwise damaging the storage area.

It is another object of the present invention to provide a method for constructing shelving so that the shelving can quickly and easily be permanently installed in an existing storage area such as a closet.

DESCRIPTION OF THE PREFERRED EMBODIMENTS

Figure 1:
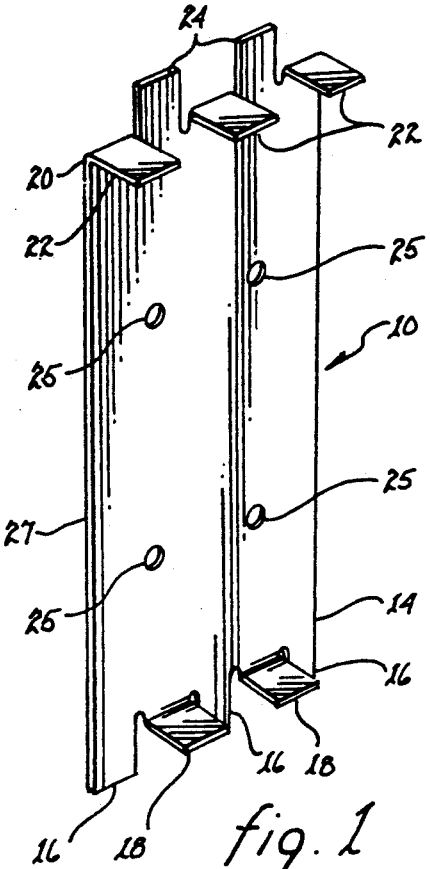
FIG. 1 is a perspective view of a shelf frame bracket used in the method of the present invention.

A shelf frame bracket provided in the method embodying the present invention is shown generally at 10 in FIG. 1. Bracket 10, which is vertically extending and approximately rectangular in shape, can be made either from metal or from a sturdy reinforced plastic; the brackets can be made in different sizes to construct shelves of different heights.

A first end 14 of each bracket 10 contains three equally spaced vertically extending first legs 16, preferably of similar rectangular shape and having a length approximately equal to a standard thickness of precut boards, preferably ¾ inches. Between adjacent first legs 16 is a first horizontally extending arm 18 similar in shape and size to the first legs. A second end 20 of each bracket 10 contains three equally spaced horizontally extending second arms 22 similar in size to and extending in the same direction as first arms 18; the second arms are adapted to support an edge of a shelf board 12. Between adjacent second arms 22 is a second vertically extending leg 24 similar in shape and size to first legs 16; second legs 24 extend in a direction opposite to that of first legs 16. If desired, a plurality of openings 25 adapted to receive screws may be pre-drilled into a main surface 27 of bracket 10 so that the brackets can be permanently attached to existing walls or other fixtures.

Figure 2:
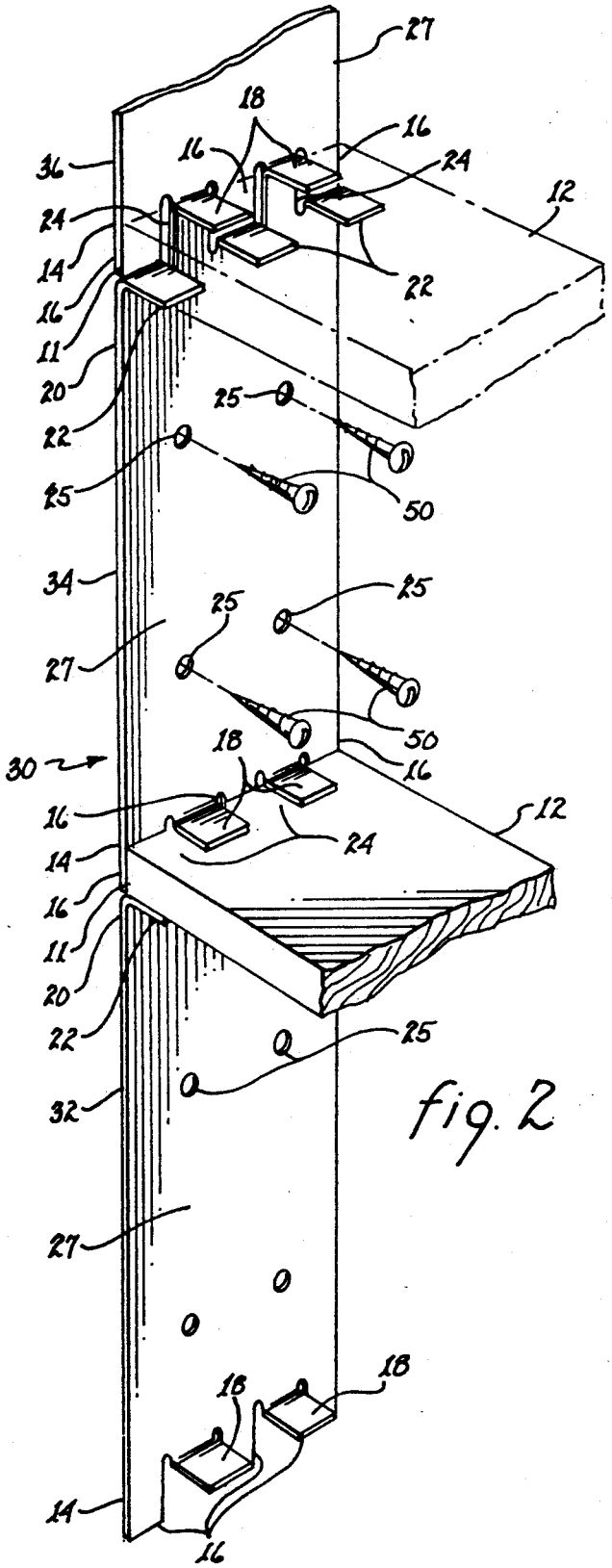
FIG. 2 is a perspective view of a portion of three vertically aligned shelf frame brackets supporting shelf boards.

As shown in FIG. 2, a plurality of brackets 10 can be aligned vertically, one above the other, to form a first bracket set 30, by aligning the first end 14 of a second bracket 34 with the second end 20 of a first bracket 32; the first legs 16 of second bracket 34 are lined up next to the second legs 24 of first bracket 32, and rest on top of second arms 22 of first bracket 32. The two second legs 24 of first bracket 32 fit underneath the two first arms 18 of second bracket 34. The first arms 18 of second bracket 34 and second arms 22 of first bracket 32 are thus spaced apart a distance equal to the length of the first legs 16 and second legs 24, that is, a distance equal to a standard thickness of precut shelf board 12, preferably about ¾ inches. A first end edge 11 of shelf board 12 will thus fit snugly in the space between the first and second arms; the shelf board can vary in width, and need not match the width of bracket 10. If another shelf is desired, bracket set 30 can be enlarged by similarly aligning the first end 14 of a third bracket 36 with the second end 20 of second bracket 34, thereby providing support for the first end edge 11 of another shelf board 12.

Figure 4:
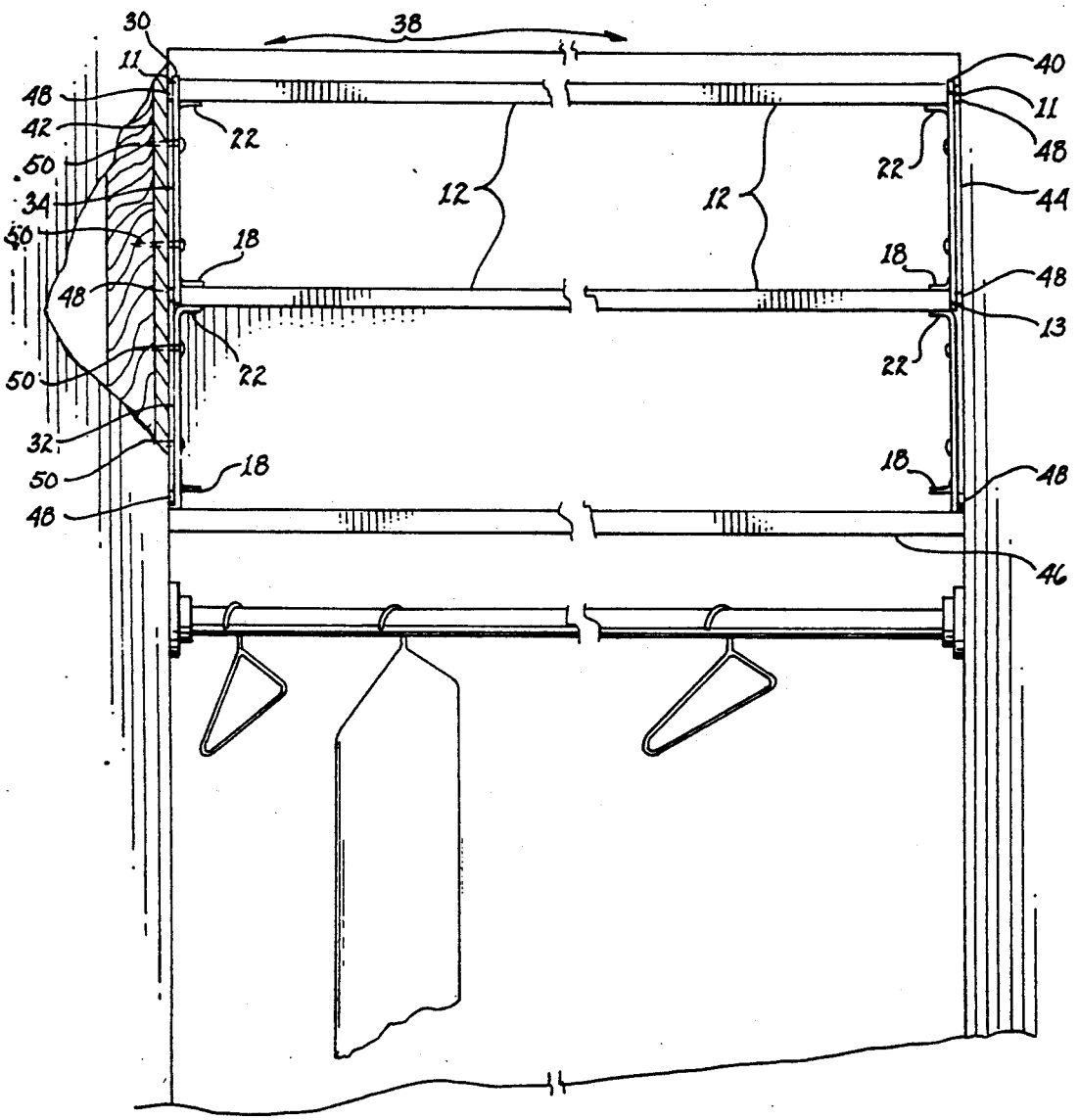
FIG. 4 is a front elevational view of the shelf frame formed by the method of the present invention, showing the frame installed in a storage area.

FIG. 4 illustrates a frame 38 created by constructing opposing first and second bracket sets 30 and 40, respectively, from vertically aligned brackets 10. The first end edge 11 of shelf board 12 is supported by the aligned first bracket 32 and second bracket 34; a second end edge 13 of the shelf board is similarly supported by opposing brackets of bracket set 40.

Figure 3:
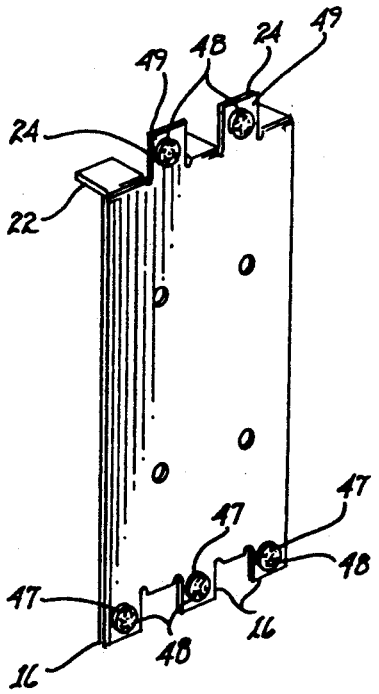
FIG. 3 is a perspective view of the back of the shelf frame bracket of FIG. 1.

As shown in FIG. 4, to install frame 38 in a closet, respective first and second bracket sets 30 and 40 are placed against opposing closet side walls 42 and 44, either on the floor of the closet or on an existing closet shelf 46. A shelf board 12 is then placed between the opposing pairs of first and second arms 18 and 22, respectively. Rubber or cork protective feet 48 (shown in detail in FIG. 3) are glued or otherwise attached to the backs 47 and 49 of first legs 16 and second legs 24 to frictionally engage bracket sets 30 and 40 against side walls 42 and 44, respectively, and protect the side walls from damage by the brackets 10. Frame 38 can be removed from the closet in a matter of minutes by removing boards 12 and disassembling bracket sets 30 and 40.

If, however, frame 38 is to be permanently installed in the closet, holes corresponding in position to bracket openings 25 can be drilled in side walls 42 and 44; screws 50 can then be inserted in the holes and openings, thereby securing the frame to the walls. A permanently installed frame 38 can of course be removed by taking out screws 50 and disassembling the frame.

Other objects, advantages and features of the present invention will become apparent from the following specification when taken in conjunction with the accompanying drawings.

I claim:

1. A method for constructing shelving between opposing walls of a storage area, the method comprising the steps of:

a. providing first and second shelf brackets wherein each of the shelf brackets comprises:
   i. a rectangular vertically extending main surface;
   ii. a plurality of equally spaced first legs extending vertically from a first end of the main surface, the first legs having a rectangular shape and a predetermined length;
   iii. a horizontally extending first arm located between each pair of adjacent first legs;
   iv. a plurality of equally spaced second arms extending horizontally from a second end of the main surface in the same direction as the first arms, the second arms adapted to support a board thereon;
   v. vertically extending second leg located between each pair of adjacent second arms, each second leg extending in a direction opposite from that of the first legs, each second leg having a shape and length approximately the same as the first legs;

b. placing the first and second shelf brackets against opposing walls; and c. placing said board on opposing second arms of the shelf brackets.

2. The method of claim 1 wherein three equally spaced first legs extend vertically from the first end of the main surface and three equally spaced second arms extend horizontally from the second end of the main surface.

3. The method of claim 2 wherein the first and second legs are approximately the same shape and have a length approximately equal to the thickness of said board.

4. A method for constructing shelving between opposing walls of a storage area, the method comprising the steps of:

a. providing first, second, third and fourth shelf brackets wherein each of the shelf brackets comprises:
   i. a rectangular vertically extending main surface;
   ii. a plurality of equally spaced first legs extending vertically from a first end of the main surface, the first legs having a rectangular shape and a predetermined length;
   iii. a horizontally extending first arm located between each pair of adjacent first legs;
   iv. a plurality of equally spaces second arms extending horizontally from a second end of the main surface in the same direction as the first arms, the second arms adapted to support a board thereon;
   v. a vertically extending second leg located between each pair of adjacent second arms, each second leg extending in a direction opposite from that of the first legs, each second leg having a shape and length approximately the same as the first legs;

b. creating a first bracket set by aligning a second of the first bracket between a pair of adjacent first legs of the second bracket and separating each first arm of the second bracket from the second arms of the first bracket by a distance sufficient to accommodate the thickness of said board therebetween;

c. creating a second bracket set by aligning a second leg of the third bracket between a pair of adjacent first legs of the fourth bracket and separating each first arm of the fourth bracket from the second arms of the third bracket by a distance sufficient to accommodate the thickness of said board therebetween;

d. placing the first and second shelf bracket sets against opposing walls; and e. placing said board on the second arms of opposing shelf bracket sets.

5. The method of claim 4 wherein three equally spaced first legs extend vertically from the first end of the main surface and three equally spaced second arms extend horizontally from the second end of the main surface.

6. The method of claim 5 wherein the first and second legs have a length approximately equal to said thickness.

7. The method of claim 1 and further comprising the step of providing a resilient protective backing to a back surface of the first and second legs to frictionally engage the opposing side walls.

8. The method of claim 1 and further comprising the steps of providing an opening in the main surfaces of the shelf brackets, adapted to receive a screw therein, and screwing the opposing frame brackets to the opposing walls.

* * * * *